US006465417B1

(12) United States Patent
Beagle et al.

(10) Patent No.: US 6,465,417 B1
(45) **Date of Patent: *Oct. 15, 2002**

(54) FABRIC CLEANING COMPOSITION CONTAINING ZEOLITE

(75) Inventors: Charles Beagle, South Plainfield, NJ (US); Richard Adams, Monmouth Junction, NJ (US); David Beck, Princeton Junction, NJ (US)

(73) Assignee: Colgate-Palmolive Co., Piscataway, NJ (US)

( * ) Notice: Subject to any disclaimer, the term of this patent is extended or adjusted under 35 U.S.C. 154(b) by 197 days.

This patent is subject to a terminal disclaimer.

(21) Appl. No.: 09/612,674

(22) Filed: Jul. 10, 2000

Related U.S. Application Data

(63) Continuation of application No. 09/350,961, filed on Jul. 9, 1999, now abandoned.

(51) Int. Cl.[7] ..... C11D 1/72; C11D 3/02; C11D 3/37

(52) U.S. Cl. ..... 510/507; 510/320; 510/323; 510/351; 510/356; 510/357; 510/361; 510/511; 510/300; 510/347; 510/509; 510/324; 510/360; 510/392; 510/421; 510/426; 510/434; 510/466; 510/475; 510/478; 510/532; 510/533

(58) Field of Search ..... 510/507, 320, 510/323, 351, 356, 357, 361, 511, 300, 347, 509, 324, 360, 392, 421, 426, 434, 466, 475, 478, 532, 533

(56) References Cited

U.S. PATENT DOCUMENTS

| | | | | | |
|---|---|---|---|---|---|
| 5,238,594 | A | * | 8/1993 | Chapple | 252/95 |
| 5,259,981 | A | * | 11/1993 | Chapple et al. | 252/95 |
| 5,259,982 | A | * | 11/1993 | Chapple | 252/95 |
| 5,431,846 | A | * | 7/1995 | Christopher et al. | 252/174.24 |
| 5,498,342 | A | * | 3/1996 | Chapple | 252/95 |
| 5,518,649 | A | * | 5/1996 | Chapple et al. | 252/174.25 |
| 5,583,098 | A | * | 12/1996 | Boskamp et al. | 510/351 |
| 6,204,239 | B1 | * | 3/2001 | Beagle et al. | 510/507 |

FOREIGN PATENT DOCUMENTS

| | | | | |
|---|---|---|---|---|
| EP | 384070 A2 | * | 8/1990 | |
| EP | 448297 A1 | * | 9/1991 | |
| EP | 502675 A2 | * | 9/1992 | |
| EP | 533392 A2 | * | 3/1993 | |
| EP | 533392 | * | 3/1993 | C11D/3/12 |
| EP | WO 94/28109 | * | 12/1994 | |
| EP | 714432 B1 | * | 6/1996 | |
| EP | WO 97/34979 | * | 9/1997 | |

* cited by examiner

*Primary Examiner*—Gregory Delcotto
*Assistant Examiner*—Brian P Mruk
(74) *Attorney, Agent, or Firm*—Richard E. Nanfeldt

(57) ABSTRACT

The present invention relates to a composition containing a MAP zeolite, ethoxylated nonionic surfactant and an alkali metal carbonate.

14 Claims, No Drawings

FABRIC CLEANING COMPOSITION CONTAINING ZEOLITE

RELATED APPLICATION

This application is a continuation in part application of U.S. Ser. No. 9/350,961 which is filed Jun. 19, 1999 now abandoned.

FIELD OF THE INVENTION

The present invention relates to a free flowing granular cleaning composition for use in fabric care, wherein the composition contains a nonionic surfactant and a zeolite MAP.

BACKGROUND OF THE INVENTION

In recent years the use of zeolite in fabric cleaning compositions as a replacement for phosphate as a detergent builder has increased because of the ability of the zeolite (crystalline alkali metal aluminosilicate) to sequester calcium ions from the aqueous wash solution.

More recently the use of the traditional Zeolite A has been replaced by the use of zeolite MAP (maximum aluminum zeolite P which has a silicon to aluminum ratio of less than 1.33), a liquid carrying capacity of less than 60, a D50 particle size of less than 1.5 and a moisture content of about 10 wt %.

Zeolite MAP has been previously disclosed in the literature. EP384070A discloses the use of zeolite MAP in a cleaning composition. EP0448297A, EP0502675A, EP0533392B1 and EP0695341B1 teaches the use of zeolite MAP in combination with a bleach system for use in cleaning compositions. PCT WO97/34979 also teaches the use of zeolite MAP in combination with a bleaching system. U.S. Pat. Nos. 5,238,594; 5,259,981; 5,259,982 and 5,498,342 are also directed to cleaning compositions containing Zeolite MAP.

SUMMARY OF THE INVENTION

The present invention relates to a free flowing granular, low foaming fabric leaning composition which comprises a zeolite MAP builder, a nonionic surfactant, less than 2.5 wt. % of an anionic surfactant, a polyacrylate polymer, at least one nonphosphate supplemental builder, which is not a zeolite and enzymes.

An object of the instant invention is to provide a free flowing granular, low foaming fabric cleaning composition which has a foam height at the end of the wash cycle in a top load washing machine at a dose level of 92 ml of less than 3 inches.

PCT WO94/28109, EP0714432B1 and U.S. Pat. Nos. 5,490,954 and 5,518,649 teach cleaning compositions using zeolite MAP in combination with high levels of anionic surfactant as well as salts of fatty acids.

The aforementioned patents fail to provide a bleach free cleaning composition which has a low foam profile of less than 3 inches such that the cleaning composition can be used in either a front or top load washing machine.

DESCRIPTION OF THE PREFERRED EMBODIMENT

The present invention relates to a free flowing granular, low foaming fabric cleaning composition having a bulk density of 0.4 to 0.85, more preferably 0.60 to 0.65 grams/cc which comprises approximately by weight:

(a) 5% to 20%, more preferably 7% to 11% of an ethoxylated nonionic surfactant;

(b) 2.5% to 30%, more preferably 12% to 18% of a zeolite on active basis or express as anhydrosis MAP zeolite having a silicon to aluminum weight ratio of less 20 than 1.33, a liquid carrying capacity of at least 65 wt. %, a D50 particle size of 2.3 to 5.0 micrometers, preferably 2.4–2.6 micrometers and a moisture content of 17–23 wt. %;

(c) 20% to 40%, preferably 32% to 38% of a supplemental detergent builder salt such as an alkali metal carbonate such as sodium carbonate;

(d) 0 to 2.5%, more preferably 0.5% to 2% of a sulfate or sulfonate anionic 25 surfactant;

(e) 0.5% to 5.0%, more preferably 1.0% to 3.0% of a polyacrylate type polymer which functions as an agglomerating aid as well as a chelating agent for calcium and/or magnesium ions as well as an antire-deposition agent;

(f) 0.5% to 35%, more preferably 15% to 25% of sodium sulfate;

(g) 0.5% to 7%, more preferably 1% to 6% of an alkali metal silicate such as sodium silicate or potassium silicate; and (h) 0 to 3%, more preferably 0.05% to 1.5% of at least one enzyme, wherein the composition does not contain an alkali metal salt of a fatty acid or a bleach compound.

The present invention also relates to a composition having a bulk density of 0.72 to 0.85, more preferably 0.75 to 0.81 grams/cc comprising approximately by weight:

(a) 5% to 60%, more preferably 10% to 45% of a MAP zeolite having a silicon to aluminum ratio of less than 1.33 a liquid carrying capacity of at least 65 wt. %, a D50 particle size of 2.3 to 5.0 micrometers, preferably 2.4–2.6 micrometers, a pore size of 350 to 600 nanometers, a porosity of at least 1.75 cc/gram and a moisture content of 17to23wt. %;

(b) 0 to 55%, more preferably 5% to 50% of an alkali metal carbonate;

(c) 0 to 10%, more preferably 0.1% to 6% of a polyacrylate type polymer;

(d) 0 to 2%, more preferably 0.1% to 1% of a brightener; and (e) 10% to 40% of an ethoxylated nonionic surfactant, wherein said ethoxylated nonionic surfactant is adsorbed on said zeolite and said alkali metal carbonate, wherein the composition does not contain a bleach compound or an alkali metal salt of a fatty acid or more than 6 wt. % of a sulfate or sulfonated surfactant.

Excluded from the instant compositions are single crystal zeolites, zeolites having a three-dimensional pore system, zeolites have a 12 ring structure such as zeolite X and zeolite Y, zeolites having circular pore openings, hydroxy sodalites, zeolites belonging to the LTA group such as zeolite A and zeolite B or zeolite P belong to the GIS group and having a Si:Al ratio of greater than 1.4, and a calcium binding capacity of less than 150 mg $C_aCO_3$/g and a surface area as measured by $N_2$ absorption of less than 20 square meters/grams of zeolite. Also excluded from the winstant compositions are: defloculatory polymers having a weight average molecular eight of above 3,000 up to and including 10,000 and containing polymer chains of the structure P-SR, wherein P represents a polymer chain segment of a hydrophile polymer and SR represents a mercapto end-cap group, R being an organic hydrophobic radical containing from about 4 to 28 carbon atoms and also excluded from the instant compositions are percarbonate bleach compounds.

Suitable anionic surfactants used in the instant compositions at less than 6 wt. % include the water-soluble alkali metal salts having alkyl radicals containing from about 8 to about 22 carbon atoms, the term alkyl being used to include the alkyl portion of higher acyl radicals. Examples of suitable synthetic anionic detergent compounds are sodium and potassium alkyl sulphates, especially those obtained by sulphating higher ($C_8$–$C_{18}$) alcohols produced, for example, from tallow or coconut oil; sodium and potassium alkyl ($C_9$–$C_{20}$) benzene sulfonates, particularly sodium linear secondary alkyl ($C_{10}$–$C_{15}$) benzene sulfonates; sodium alkyl glycerol ether sulfates, especially those ethers of the higher alcohols derived from tallow or coconut oil and synthetic alcohols derived from petroleum; sodium coconut oil fatty monoglyceride sulfates and sulfonates; sodium and potassium salts of sulfuric acid esters of higher ($C_8$–$C_{18}$) fatty alcohol-alkylene oxide, particularly ethylene oxide reaction products; the reaction products of fatty acids such as coconut fatty acids esterified with isethionic acid and neutralized with sodium hydroxide; sodium and potassium salts of fatty acid amides of methyl taurine; alkane monosulfonates such as those derived from reacting alpha-olefins ($C_8$–$C_{20}$) with sodium bisulfite and those derived from reacting paraffins with $SO_2$ and $Cl_2$ and then hydrolyzing with a base to produce a random sulfonate; and olefin sulfonates which term is used to describe the material made by reacting olefins, particularly $C_{10}$–$C_{20}$ alpha-olefins, with $SO_3$ and then neutralizing and hydrolyzing the reaction product. The preferred anionic surfactants are ($C_{10}$–$C_{18}$) alkyl polyethoxy (1–11 Eo) sulfates and mixtures thereof having differing water solubilities.

Suitable nonionic surfactants used in the instant compositions include, in particular, the reaction products of compounds having a hydrophobic group and a reactive hydrogen atom, for example aliphatic alcohols, acids, amides and alkyl phenols with alkylene oxides, especially ethylene oxide, either alone or with propylene oxide. Specific nonionic surfactant compounds are alkyl ($C_6$–$C_{18}$) primary or secondary linear or branched alcohols condensed with ethylene oxide, and products made by condensation of ethylene oxide with the reaction products of propylene oxide and ethylenediamine. [Other so-called nonionic surfactant compounds include long chain tertiary amine oxides, long-chain tertiary phosphine oxides, dialkyl sulfoxides, fatty ($C_8$–$C_{18}$) esters of glycerol, sorbitan and the like, alkyl polyglycosides, ethoxylated glycerol esters, ethyoxylated sorbitans and ethoxylated phosphate esters.]

The preferred non-ionic surfactant compounds are those of the ethoxylated and mixed ethyoxylated-propyloxylated ($C_{12}$–$C_{15}$), ($C_{12}$–$C_{14}$) ($C_{14}$–$C_{16}$) fatty alcohol or synthetic alcohol, containing 6 to 11 ethylene oxide (EO) groups.

The Zeolite MAP used in the instant compositions is defined as an alkali metal aluminosilicate having a silicon to aluminum ratio not greater than 1.33, preferably within the range of from 0.9 to 1.33, and more preferably within the range of 0.9 to 1.2. Of especial interest is zeolite MAP having a silicon to aluminum ratio not greater than 1.15; and zeolite MAP having a silicon to aluminum ratio not greater than 1.07 is especially preferred. Although zeolite MAP like other zeolites contains water of hydration, for the purposes of the present invention amounts and percentages of zeolite are generally expressed in terms of the notional anhydrous material. The amount of water present in hydrated zeolite MAP at ambient temperature and humidity is normally about 20 wt. %. Zeolite MAP generally has a calcium binding capacity of at least 150 mg CaO per g of anhydrous aluminosilicate, as measured by the standard method described in GB1473201 (Henkel) and also described, as "Method I" in EP384070A (Unilever). The calcium binding capacity is normally at least 160 mg CaO/g and may be as high as 170 mg CaO/g. Zeolite MAP also generally has an "effective calcium binding capacity" measured as described under "Method II" in EP384070A (Unilever) of at least 145 mg CaO/g, preferably at least 150 mg CaO/g.

Preferred zeolite MAP for use in the present invention is especially finely divided and has a $d_{50}$ (as defined below) within the range of from 2.3 to 5.0 micrometers, more preferably at least 2.4 to 2.7 micrometer, more preferably at least 2.4 micrometers. The quantity "$d_{50}$" indicates that 50 wt. % of the particles have a diameter smaller than that figure. The preferred zeolite MAP has a moisture content of 17 wt. % to 23 wt. %, preferably at least 20 wt. % and a liquid (liquid is A2 type nonionic) carrying capacity of at least 65 wt. %, preferably at least 67 wt. %.

Various methods of measuring particle size are known, and all give slightly different results. In the present specification, the particle size distributions and average values (by weight) quoted were measured by means of a Sedigraph 5100.

Advantageously, but not essentially, the zeolite MAP may have not only a small average particle size, but may also contain a low proportion, or even be substantially free, of large particles. Thus the particle size distribution may advantageously be such that at least 90 wt. % and preferably at least 95 wt. % are smaller than 10 micrometers; at least 85 wt. % and preferably at least 90 wt. % are smaller than 6 micrometers; and at least 80 wt. % and preferably at least 85 wt. % are smaller than 5 micrometers.

The zeolite MAP in the instant composition is used in conjunction with other inorganic or organic builders. Inorganic builders that may be present include the sodium carbonate. Organic builders that may be present include polycarboxylate polymers such as polyacrylates, acrylic/maleic copolymers, and acrylic phosphonates; monomeric polycarboxylates such as citrates, gluconates, oxydisuccinates, glycerol mono-, di- and trisuccinates, carboxymethyloxysuccinates, carboxymmethyloxymalonates, dipicolinates, hydroxyethyliminodiacetates, alkyl- and alkenylmalonates and succinates; and sulphonated fatty acid salts. This list is not intended to be exhaustive. Builders, both inorganic and organic, are preferably present in alkali metal salt, especially sodium salt, form.

The alkali metal silicate such as sodium or potassium silicate used in the instant compositions are generally added in the form of an aqueous solution, preferably having $Na_2O:SiO_2$ ratios of about 1:1.3 to about 1.28 and $K_2O:SiO_2$ ratios of about 1:2.0 to about 1:2.6.

The polyacrylate type polymer used in the instant compositions as a calcium sequestering agent is selected from the group consisting of a sodium or potassium salt of a copolymer of polyacrylic acid and maleic anhydride having a molecular weight of about 1,000 to about 5,000 such as Alcoa AR978 sold by Alco Chemical and Alcosperse™ 412 sold by Alco Chemical which is a terpolymer of polyacrylic acid, maleic anhydride and polyacrylamide. This terpolymer which has a molecular weight of about 1,000 to about 6,000 is characterized by the formula:

| | | | | | | | | |
|---|---|---|---|---|---|---|---|---|
| H | H | | H | H | | H | H' | |
| C | C | a | C | C | b | C | C | c |
| | | | H | | | H" | | |
| HOOC | COOH | | | COOH | | | $CONH_2$ | |

wherein a+b+c=1; a≧b+c; and c≦0.1

The detergent composition may also contain one or more enzymes which are active against biodegradable stains, e.g., starches, vegetable and blood, and which are also active at a pH of about 5 to about 12. Preferred enzymes which may be used include amylolytic enzymes (alpha amylases), alkaline and neutral proteases, lipolases, cellulases and the like, and mixtures thereof.

Alkaline or neutral proteolytic enzymes suitable for the present composition include the various commercial liquid enzyme preparations which have been adapted for use in detergent compositions. Enzyme preparations in powdered form are also useful although, as a general rule, less convenient for incorporation into a built liquid detergent composition. Thus, suitable liquid enzyme preparations include "Alcalase" and "Savinase", trademarked products sold by Novo Industries, Copenhagen, Denmark, and "Purafect" and "Properase" sold by Genencor, Rochester, N.Y.

Other suitable alpha-amylase liquid enzyme preparations are those sold by Novo Industries and Genencor under the tradenames "Termamyl" and "Purastar", respectively. Another enzyme preparation which may be used is a powdered enzyme preparation containing alpha-amylase and a mixture of alkaline and neutral proteases available as CRD-Protease from the Monsanto Co of St. Louis, Mo.

The enzymes are normally present in the detergent composition at a level of from about 0 up to about 3 wt. %, more preferably from about 0.05 to 1.5 wt. %.

The detergent composition may also contain one or more softening components known in the art. Suitable softeners include swelling bentonite clays such as sodium and calcium montmorillonites, sodium saponites and sodium hectorites. These may be present in the detergent composition at levels of from about 0.5 to 20 wt. %, more preferably from about 5 to 15 wt. %.

Other conventional materials may also be present in the liquid detergent compositions of the invention, for example, soil-suspending agent, silicon antifoaming agents and cationic antifoaming agents. Typical cationic antifoaming agents are dimethyl dialkyl ($C_{8-22}$) ammonium chloride, methyl benzyl dialkyl ($C_{2-18}$) ammonium chloride and $C_{12}$–$C_{22}$ alkyl trimethyl ammonium chloride and mixtures thereof. Typical silicon antifoaming agents are sold by Dow Corning are Q2-3302, 2-3485, 2-4248S and 2200. The composition can also contain sequesterants such as salts of ethylene diamine tetraacetic acid or analogous phosphonic acid salts, hydrotropes, corrosion inhibitors, dyes, perfumes, germicides, e.g., preservatives, e.g., quaternium 15, anti-tarnishing agents, buffers and the like. Such other conventional materials may be used in the amounts they are normally used generally up to about 5% by weight, more preferably up to about 3% by weight.

As necessary, pH modifiers, such as water soluble bases, e.g., NaOH, KOH, amines, or ammonia, will be added to obtain the desired pH level. The preferred pH will range from about 8 up to 11, more preferably from about 9 up to less than 11.

Excluded from the instant compositions are zeolites selected from the group consisting of Zeolite A, Zeolite B or Zeolite P (Zeolite B is now known in industry as Zeolite P) having an Si:Al ratio greater than 1.40, Zeolite X, Zeolite Y and Zeolite HS and Zeolite MAP having less 15 wt. % of water of hydration.

The instant compositions are made by an agglomeration process. In the agglomeration process, liquid components can be added to the powder components in several ways. In some cases, the entire liquid portion of the formulation can be added to the powder components in the agglomerator itself (Method 1). In other cases, some of the liquids can be pre-loaded on to a portion or all of the powder components before the final liquid constituents are added in the agglomerator device (Method 2). For this invention, both methods have been employed successfully. Method 2 is preferred.

Using the preferred methods, all or part of the nonionic surfactant mix is loaded onto either zeolite or a combination zeolite and sodium carbonate mix in a suitable liquid/solids mixing device. Examples of such mixing equipment are Ross mixers, Lodige, ribbon or paddle mixers, and Schugi contactors, etc. Surfactant loading can range from 0.1 to 60% of the powder weight. This step allows the surfactant material to be adsorbed by the powder material. Adsorption is a function of time, temperature, porosity, pore size, surfactant size, surface area, mixing energy and capillary action. After application of the surfactant, additional powder materials such as zeolite, sodium carbonate, or other type materials can be added to the mix. In addition, if the entire surfactant component was not initially added, part or all of the remaining surfactant component or other liquid compotents can be added at this time. The powder/surfactant mix is then mechanically or pneumatically conveyed to a small holding bin or directly into an agglomerator.

In the preferred method, the material is conveyed into a small bin. From this bin, the surfactant/zeolite/carbonate mix is metered and fed into a Schugi type agglomerator, In addition to the surfactant/zeolite/carbonate mix additional powder components can be added to the Schugi other suitable agglomerator. Examples of such materials are: brighteners and polymers. In the Schugi agglomerator, liquid polymers, of potentially differing types, and water are added as binders. These materials are added in the appropriate amount to generate the chemical composition and physical properties, i.e., particle size, desired.

From the Schugi agglormerator, the material is conveyed via mechanical device or by gravity to a fluid bed dryer. In this dryer, a combination of hot and cold air is used to dry and condition the material. From the fluid bed dryer, the free flowing material can be used as is or mixed with a variety of materials to form detergents of any composition. Examples of such materials are: detergent or detergent components made via the conventional spray dry process, enzymes, flow aids, perfumes or brighteners.

The detergent compositions of this invention are suitable for use as laundry detergents, dishwasher detergents, shampoos, body lotions and the like and may be modified by inclusion of specific known ingredients to accommodate these applications, e.g., dispersing agents, skin conditioning agents, antidandruff agents and the like.

The detergents of the invention are generally added to wash water at levels in the range of about 0.05 to 0.30 wt. %. For conventional washing machines; powder detergents are preferably used at levels of about 60 to 300 grams per load.

The following examples are illustrative of the invention.

EXAMPLE I

The following compositions in wt. % were prepared by the previously defined process.

| | A | B | Reference |
|---|---|---|---|
| Sodium linear alkyl benzene sulfonate | 1.4 | 1.4 | 8.9 |
| Nonionic surfactant 24-7 | 9.9 | 10.5 | 7.0 |
| Sodium carbonate | 35 | 35 | 31.3 |
| Zeolite 4A (dry basis) | — | — | 18.7 |
| Zeolite high absorbent (dry basis) MAP[1] | 15.0 | 16.0 | — |
| Sodium sulfate | 20.7 | 20.3 | 15.2 |
| Sodium polyacrylate | 2.5 | 2.5 | 2.5 |
| Sodium silicate | 5.0 | 5.0 | 4.4 |
| Protease Enzyme | 0.5 | 0.3 | 0.3 |
| Optical brightener | 0.3 | 0.3 | 0.3 |
| Fragrance | 0.4 | 0.4 | 0.4 |
| Moisture | Bal. | Bal. | Bal. |
| Density grams/cc | 0.61 | 0.61 | 0.61 |

[1]Dowal A30 D50 - 2.5 micrometers, 20 wt. % moisture and liquid carrying capacity of 68 wt. %.

Detergency Test
12 Stain Multistain Test
Average Total L *(Hunter Scale)

| | Top Loader 10 min. Wash | | Front Loader 18 min. Wash | | Dose |
|---|---|---|---|---|---|
| | 60° F. | 90° F. | 60° F. | 90° F. | in ml. |
| New | 1045 | 1056 | 1039 | 1055 | 120 |
| Current | 1041 | 1053 | 1042 | 1054 | 92 |

Foam Study #1 at 90° F.

| Product | Dose ml. | Foam Height End of Wash | Foam Height End of Rinse | Average Total L* | |
|---|---|---|---|---|---|
| | | Front Loader | | | |
| New | 92 | None detected | None detected | 1049 | foam height |
| Current | 92 | 3 inches | None detected | 1080 | was measured |
| New | 220 | 2.5 inches | None detected | 1081 | with ruler |
| Current | 220 | 6+ inches | 6+ inches | 1074 | attached to door window of washer. |
| | | Top Loader | | | |
| New | 92 | Trace | None detected | 1049 | foam height |
| Current | 92 | 5 inches | Trace | 1061 | was measured |
| New | 220 | 5 inches | Trace | 1084 | with ruler hand |
| Current | 220 | 6 inches | Trace | 1082 | held from surface of water in the washer. |

All washes for the foam study contained four pound ballast loads which included a set of the Twelve Stain Multistain Test swatches as a standard soil load. All wash cycles were run for eighteen minutes. The 92 ml. Level represents the lowest marked volume used with the Regular Ultra scoop. The 220 ml. Level represents the proposed full scoop volume used with the Bleach Alternative Ultra (representing a best and worst case foam generation of the respective formulas in the different washers currently available to the consumer). All washes were duplicated.

Foam Study #2 at 60° F.

| Product | Dose ml. | Foam Height End of Wash | Foam Height End of Rinse | Average Total L* | |
|---|---|---|---|---|---|
| | | Front Loader (18 min. wash) | | | |
| New 24-7 | 160 | 3 inches | 0.5 inches | 1069 | foam height |
| New 46-7 | 160 | 0.5 inches | None detected | 1068 | was measured |
| Current | 160 | 6+ inches | 6+ inches | 1062 | with ruler attached to door window of washer. |
| | | Top Loader (10 min. wash) | | | |
| New 24-7 | 160 | 3 inches | Trace | 1036 | foam height |
| New 46-7 | 160 | 0.13 inches | None detected | 1031 | was measured |
| Current | 160 | 4 inches | Trace | 1041 | with ruler handheld from surface of water in the washer. |

All washes for foam study contained four pound ballast loads which included a set of the Twelve Stain Multistain Test Swatches as a standard soil load. The 160 ml. represents the Large level used with the Regular Ultra Scoop.

What is claimed:

1. A cleaning composition comprising approximately by weight:

(a) 5% to 20% of an ethoxylated nonionic surfactant;

(b) 25% to 30% of a MAP zeolite having a silicone to aluminum weight ratio of less than 1.33 and a particle size of at least 2.3 micrometers;

(c) 20% to 40% of a supplemental detergent builder salt;

(d) 0.5% to 5% of a polyacrylate polymer; and (e) 0.5% to 35% of a sodium sulfate, wherein the composition does not contain a bleach compound or an alkali metal salt of a fatty acid or more than 6 wt. % of a sulfated or sulfonated surfactant.

2. The composition of claim 1 further including an anionic surfactant.

3. The composition of claim 1 further including at least one enzyme.

4. The composition of claim 3 wherein at least one of said enzymes is a protoelytic enzyme.

5. The composition of claim 4 wherein said supplemental detergent builder salt is sodium carbonate.

6. The composition of claim 5 wherein said ethoxylated nonionic surfactant contains 6 to 11 ethylene oxide groups.

7. The composition of claim 2 wherein said anionic surfactant is a sulfonate surfactant.

8. The composition of claim 7 wherein said polyacrylate polymer is a terpolymer of polyacrylamide, polyacrylic acid and maleic anhydride.

9. The composition of claim 1 wherein the zeolite has a particle size of at least 2.4 micrometer.

10. A composition comprising approximately by weight:

(a) 5% to 60% of a MAP zeolite having a particle size of at least 2.3 micrometers;

(b) 0 to 55% of an alkali metal carbonate; and (c) 10% to 40% of an ethoxylated nonionic surfactant, wherein the composition does not contain a bleach compound or an alkali metal salt of a fatty acid or more than 6 wt. % of a sulfated or sulfonated surfactant.

11. The composition of claim 10 wherein said zeolite has a silicone to aluminum weight ratio of less than 1.33.

12. The composition of claim 11 wherein said alkali metal carbonate is sodium carbonate at a concentration level of 5 wt. % to 40 wt. %.

13. The composition of claim 12 wherein said ethoxylated nonionic surfactant has 6 to 11 ethylene oxide groups.

14. The composition of claim 10 further including a polyacrylate polymer.

* * * * *